US009599435B2

(12) United States Patent
Werner

(10) Patent No.: US 9,599,435 B2
(45) Date of Patent: Mar. 21, 2017

(54) SIGHTING APPARATUS FOR USE WITH A FIREARM THAT DISCHARGES AMMUNITION HAVING MULTIPLE PROJECTILES

(71) Applicant: Blaze Optics LLC, Fairbanks, AK (US)

(72) Inventor: Nathan Philip Werner, Fairbanks, AK (US)

(73) Assignee: Blaze Optics LLC, Fairbanks, AK (US)

( * ) Notice: Subject to any disclaimer, the term of this patent is extended or adjusted under 35 U.S.C. 154(b) by 0 days.

(21) Appl. No.: 15/093,125

(22) Filed: Apr. 7, 2016

(65) Prior Publication Data

US 2016/0282085 A1 Sep. 29, 2016

Related U.S. Application Data

(62) Division of application No. 13/791,135, filed on Mar. 8, 2013, now Pat. No. 9,335,119.

(51) Int. Cl.

| | |
|---|---|
| ***F41G 1/35*** | (2006.01) |
| ***F41G 1/52*** | (2006.01) |
| *F41G 1/473* | (2006.01) |

(52) U.S. Cl.

CPC ..... *F41G 1/35* (2013.01); *F41G 1/52* (2013.01); *F41G 1/473* (2013.01)

(58) Field of Classification Search

CPC ..... F21G 3/04; F21G 1/34; F21G 1/35; F21G 1/345; F21G 1/473

USPC ..... 42/115

See application file for complete search history.

(56) References Cited

U.S. PATENT DOCUMENTS

| | | | | |
|---|---|---|---|---|
| 8,375,620 | B2 * | 2/2013 | Staley, III | F41G 1/48 42/105 |
| 8,904,698 | B2 * | 12/2014 | Riley | F41G 1/35 362/110 |
| 9,335,119 | B2 * | 5/2016 | Werner | F41G 1/35 |
| 2010/0282843 | A1 * | 11/2010 | Staley, III | F41G 1/52 235/404 |
| 2012/0126001 | A1 * | 5/2012 | Justice | F41G 1/38 235/404 |
| 2014/0370466 | A1 * | 12/2014 | Axerud | F41J 5/02 434/22 |

* cited by examiner

*Primary Examiner* — Anabel Ton

(74) *Attorney, Agent, or Firm* — Hartman Global IP Law; Gary M. Hartman; Domenica N. S. Hartman

(57) ABSTRACT

A weapon system comprises a firearm configured for discharging ammunition having multiple projectiles and a sighting apparatus integral with the firearm. The sighting apparatus outputs a beam of light having a generally round shape. The sighting apparatus is oriented such that a centerline longitudinal axis of a barrel of the firearm extends through the beam of light. The sighting apparatus includes a light beam size selector for allowing a cross-sectional size of the beam of light at a fixed reference location external to the sighting apparatus to be selectively adjusted by a shooter of the firearm to a plurality of different cross-sectional sizes.

18 Claims, 4 Drawing Sheets

SIGHTING APPARATUS FOR USE WITH A FIREARM THAT DISCHARGES AMMUNITION HAVING MULTIPLE PROJECTILES

CROSS REFERENCE TO RELATED APPLICATIONS

This is a division patent application of co-pending U.S. patent application Ser. No. 13/791,135, filed Mar. 8, 2013. The contents of this prior application are incorporated herein by reference.

FIELD OF THE DISCLOSURE

The disclosures made herein relate generally to sighting and target acquisition apparatuses for firearms and, more particularly, to a sighting apparatus specifically configured for use with a firearm that discharges ammunition having multiple projectiles.

BACKGROUND

Tactical or defensive situations often require very fast target acquisition and firing. As a result of this, it is often impractical for a shooter to raise their firearm sufficiently to utilize gun-mounted alignable sights (e.g., a rib and small sphere on a barrel of a shotgun). Furthermore, tactical and defensive situations often occur in dark or poorly lit environments where the gun-mounted alignable sights may not be adequately visible.

It is well known that a shotgun is a type of firearm that discharges ammunition having multiple projectiles. Tactical (i.e., defensive) shotguns are generally characterized as having a relatively short barrel and a pump or semi-automatic action. Tactical shotguns usually have a "straight barrel", meaning they do not utilize a choke arrangement to limit the spread of the shot pellets. They are primarily intended for use in close-quarters combat and defense situations. Because these situations usually occur indoors, these types of firearm generally have an effective range of less than 20 m but can be loaded with slug ammunition for increase effectiveness at long range. The preferred ammunition for a tactical shotgun is referred to as '00' Buck (i.e., double aught buck).

Known laser sights provide a shooter of a firearm with relatively fast target acquisition in low light, which is desirable. However, these same known laser sights suffer from one or more shortcomings. One such shortcoming of some known laser sights, particularly in regard to use with a shotgun, is that they project a single dot as an aimpoint. Using a single dot as an aimpoint does not provide the shooter feedback on the impact pattern (due to range) of his projectiles and thus has limited benefit for use with a firearm that discharges ammunition with multiple projectile (e.g., a shotgun). Another such shortcoming of some known laser sights is that, although they output an illuminated sighting ring (i.e. a circular sighting reference) that provides the shooter feedback on the impact pattern, these types of laser sights have the shortcoming in that the size of the illuminated sighting ring is not adjustable on a per-payload basis for different configurations of ammunition used in a shotgun (i.e., size of ring varies only as a function of distance to a target). As such, the intended benefit of the illuminated sighting ring is adversely impacted due to an inability to provide an illuminated sighting ring of a size that is dependent upon the type of payload a particular ammunition has and the distance to the intended target when discharging that particular ammunition.

Therefore, a sighting apparatus that overcomes drawbacks associated with using known types of laser sights on a firearm that discharges ammunition with multiple projectiles would be advantageous, desirable and useful.

SUMMARY OF THE DISCLOSURE

Embodiments of the present invention are directed to a sighting apparatus specifically configured for firearms that discharge ammunition with multiple projectiles. More specifically, embodiments of the present invention are directed to a sighting apparatus for shotguns that projects a sighting reference (e.g., a circular sighting reference that can be ring-shaped) onto a target using a laser for providing the shooter with a probable impact pattern and visual indication of range. This sighting apparatus provides the shooter of a shotgun with feedback on the projectile pattern through projection (i.e., output) of the sighting reference. Advantageously, embodiments of the present invention enable a size (e.g., diameter) of the sighting reference to be adjusted on a per-payload basis for different configurations of ammunition used in the shotgun such that the illuminated sighting ring approximates a spread of the projectiles fired from the shotgun. In this regard, the size of the sighting reference is a function of distance to a target and configurations of ammunition used in the shotgun. Embodiments of the present invention can also be implemented with a dot at a central region of the sighting reference for providing targeting function with slug ammunition.

In one embodiment of the present invention, a sighting apparatus for use with a weapon that discharges ammunition having multiple projectiles comprises a laser light emitting unit and light beam size selector coupled to the laser light emitting unit. The laser light emitting unit configured for outputting a beam of light having a generally round shape. The laser light emitting unit enables a cone angle of the beam of light to be selectively adjusted. The light beam size selector enables selection of a plurality of different light beam size settings. Selection of a particular one of the light beam size settings causes the beam of light to have a corresponding cone angle that is different that the cone angle corresponding to each other one of the light beam size settings.

In another embodiment of the present invention, a sighting apparatus for use with a weapon that discharges ammunition having multiple projectiles comprises a light generator, a light ring generator and a cone angle adjuster. The light generator outputs a column-shaped beam of laser light. The light ring generator receives the column-shaped beam of laser light and produces a ring-shaped beam of laser light from the column-shaped beam of laser light. The ring-shaped beam of laser light has a first cone angle. The cone angle adjuster receives the ring-shaped beam of laser light. The cone angle adjuster is movable to a plurality of cone angle adjustment settings. The cone angle adjuster being moved to a particular one of the cone angle adjustment settings causes the ring-shaped beam of laser light to be transitioned from having the first cone angle to a respective adjusted cone angle different than the first cone angle. The respective adjusted cone angle for each one of the cone angle adjustment settings is different than the respective adjusted cone angle for each other one of the cone angle adjustment settings.

In another embodiment of the present invention, a weapon system comprises a firearm configured for discharging ammunition having multiple projectiles and a sighting apparatus integral with the firearm. The sighting apparatus outputs a beam of light having a generally round shape. The sighting apparatus is oriented such that a centerline longitudinal axis of a barrel of the firearm extends through the beam of light. The sighting apparatus includes a light beam size selector for allowing a cross-sectional size of the beam of light at a fixed reference location external to the sighting apparatus to be selectively adjusted by a shooter of the firearm to a plurality of different cross-sectional sizes.

These and other objects, embodiments, advantages and/or distinctions of the present invention will become readily apparent upon further review of the following specification, associated drawings and appended claims.

DETAILED DESCRIPTION

Figure 1:
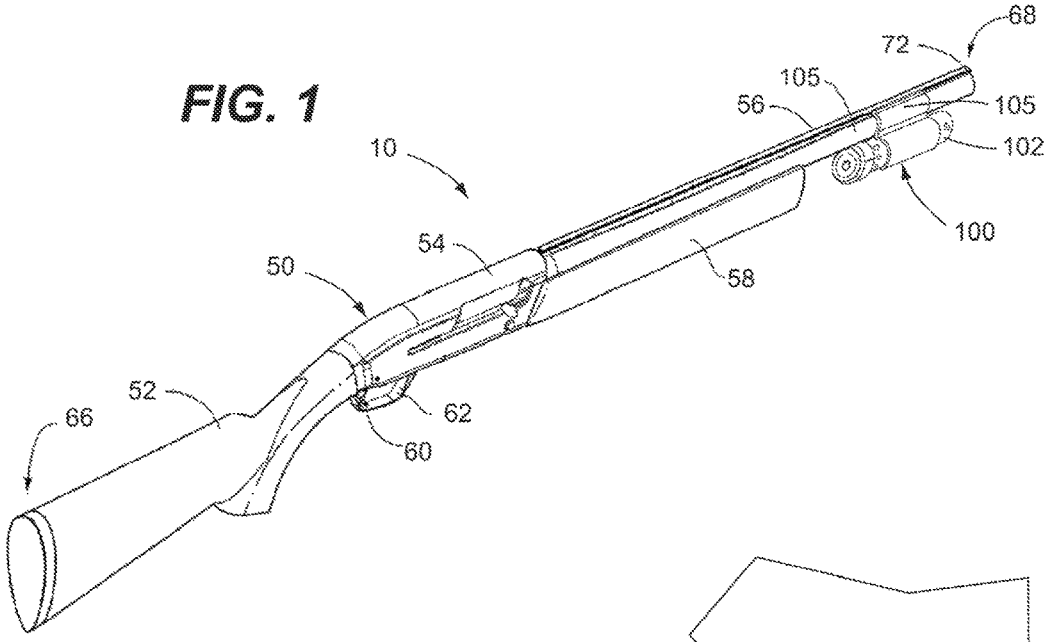
FIG. 1 is a perspective view showing a weapon system configured in accordance with an embodiment of the present invention.

With reference to FIG. 1, a weapon system 10 configured in accordance with an embodiment of the present invention is shown. The weapon system 10 includes a shotgun 50 and a sighting apparatus 100 that is mounted on (i.e., integral with) the shotgun 50. The sighting apparatus 100 is attached to the shotgun 50 through a suitable mounting means. The specific mounted arrangement of the sighting apparatus 100 is one example of an approach for providing a sighting apparatus configured in accordance with an embodiment of the present invention on a shotgun. In view of the disclosures made herein, a skilled person will appreciate other approach for providing a sighting apparatus configured in accordance with an embodiment of the present invention on a firearm such as, for example, a shotgun.

The shotgun 50 includes a stock 52, a receiver 54, a barrel 56, and a forearm 58. The stock 52 is coupled to the receiver 54 and extends rearward from the receiver 54. The barrel 56 and the forearm 58 are coupled to the receiver 54 and extend forward from the receiver 54. The terms rear, rearward, back, and the like are used to refer to the general direction of the shotgun 50 where the butt 66 is located. The terms front, forward, and the like are used to refer to the general direction of the shotgun 50 where the muzzle 68 is located. The barrel 56 includes a rib 70 and a sight 72. The rib 70 extends along the top of the barrel 56 to the muzzle 68. The sight 72 is a BB (i.e., a small sphere) positioned on top of the rib 70 at the muzzle 68. The rib 70 and the sight 72, which are jointly referred to herein as gun-mounted alignable sights, are used to aim the shotgun 72 through alignment of the rib 70 with the sight 72. As discussed above, for any number of reasons, it is often impractical for a shooter of a shotgun (e.g., the shotgun 50 of FIG. 1) to raise the shotgun sufficiently to utilize the gun-mounted alignable sights.

Figure 2:
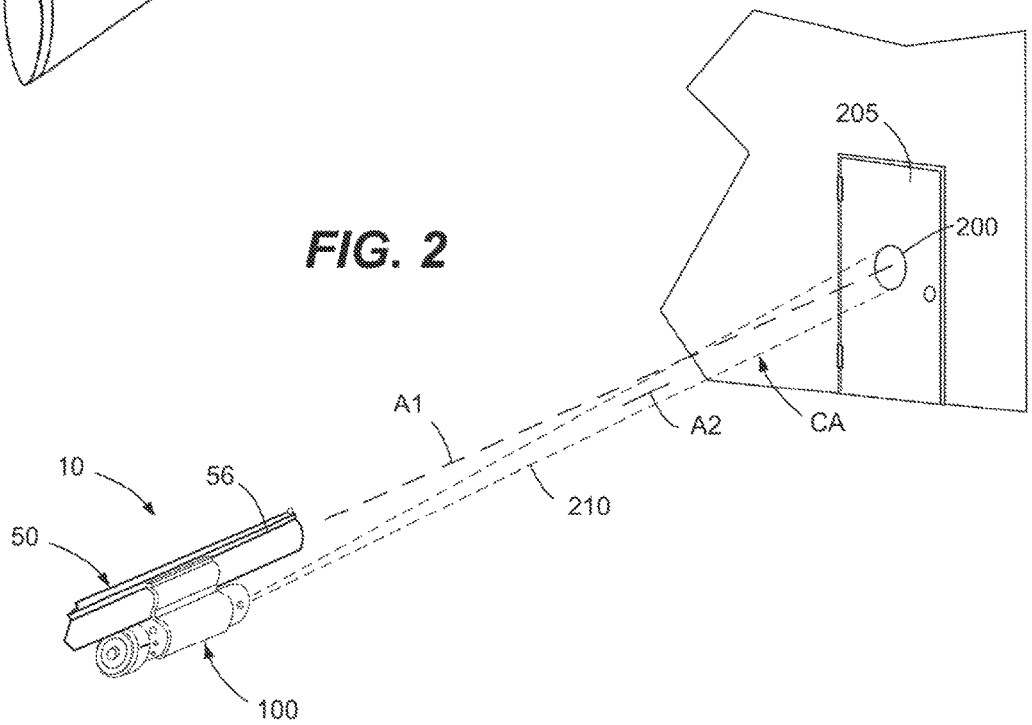
FIG. 2 is an illustrative view showing relative orientation of a sighting reference and barrel centerline axis of the weapon system shown in FIG. 1.

Advantageously, the sighting apparatus 100 enables a shooter of the shotgun 50 to accurately aim the shotgun 50 without the use of the rib 70 and the sight 72 (i.e., the gun-mounted alignable sights). As shown in FIG. 2, the sighting apparatus 100 projects a ring-shaped (i.e., circular and round) sighting reference 200 onto a target 205. The sighting apparatus 100 is aligned to the shotgun 50 such that a centerline longitudinal axis A1 of the barrel 56 extends through the ring-shaped sighting reference 200. To this end, the centerline longitudinal axis A1 of the barrel 56 is sighted into (i.e., aligned with) a centerline longitudinal axis A2 of a beam of light 210 that produces the ring-shaped sighting reference 200. The ring-shaped sighting reference 200 provides the shooter with a probable impact pattern and visual indication of range for projectiles of ammunition discharged using the shotgun 50 (i.e., a shotgun shell with slugs or shot). Accordingly, the sighting apparatus 100 provides the shooter of the shotgun 50 with feedback on the projectile pattern through projection of the ring-shaped sighting reference 200 to aid the shooter in accurately aiming the shotgun 50 at the target 205 without having to raise the shotgun 50 for utilizing the gun-mounted alignable sights.

Referring now to FIG, 3, the sighting apparatus 100 includes a housing 102 with an integral mounting bracket 105. The mounting bracket 105 is configured for being attached to the barrel 56 of the shotgun 50. The sighting apparatus 100 includes a sighting-in adjuster 110. The sighting-in adjuster 110 provides for adjustment of the centerline longitudinal axis A2 of a beam of light 210 with respect to the centerline longitudinal axis A1 of the barrel 56. Furthermore, it is disclosed herein that the sighting-in adjuster 110 can be used to adjust the sighting apparatus 100 for parallax with respect to the shotgun 50. Embodiments of the present invention are not limited to any particular implementation for enabling sighting-in and/or parallax adjustment functionalities. Furthermore, embodiments of the present invention are not limited to any particular type of mounting implementation (e.g., a rail mounting system could be utilized).

Within the housing are components for generating the beam of light 210, which are discussed below in greater detail. The sighting apparatus 100 includes an activation switch 115 for enabling selective activation of the sighting apparatus 100 (i.e., electrical/electronic components thereof). As shown, the activation switch 115 is located on the housing 102 (e.g., extends from within an interior space of the housing 102 through an opening within an exterior wall of the housing 102). Alternatively, the activation switch 115 can be remotely located on or near a portion of the shotgun 50 (e.g., the forearm 58, a trigger 60, a trigger guard 62, etc).

A key aspect of a sighting apparatus configured in accordance with embodiments of the present invention relates to adjustability as a function of projectiles being fired from a firearm on which the sighting apparatus is mounted. In reference to the sighting apparatus 100 disclosed herein, a light beam size selector 120 is provided for allowing a shooter of the shotgun 50 to selectively adjust a cross-sectional size of the beam of light 210 at a fixed reference location external to the sighting apparatus (e.g., at a typical distance to an intended target). Through such adjustment, a size of the ring-shaped sighting reference 200 at a given distance from the sighting apparatus 100 can be adjusted to reflect an estimated projectile spread based on a size, weight, shape, etc of projectiles for a particular ammunition being discharge. To accomplish this adjustability of the ring-shaped sighting reference 200, as discussed below in greater detail, the light beam size selector 120 can cause a cone angle CA of the beam of light 210 to be adjustable. For example, the light beam size selector 120 can allow the beam of light 210 to be adjusted between three different cone angles (i.e., beam of light cross sectional sizes) and have indicia 125 designated those three different settings. In this regard, each one of the settings of the light beam size selector 120 corresponds to at least one of a relative size of the cone angle and a relative configuration (e.g., size, weight, shape, etc) of a projectile being discharged from the shotgun 50.

The light beam size selector 120 can extend from within an interior space of the housing 102 through an opening within an exterior wall of the housing 102. As shown, the light beam size selector 120 can be a rotatable collar that is mechanically and/or electrically connected to components within the housing 102 that generate the beam of light 210. Optionally, the light beam size selector 120 could be a slideable switch or other suitable control mechanism that is coupled (e.g., mechanically and/or electrically) to components within the housing 102 that generate the beam of light 210. Embodiments of the present invention are not limited to any particular implementation for enabling a shooter to readily and selectively adjust the cross-sectional size of the beam of light 210.

Figure 3:
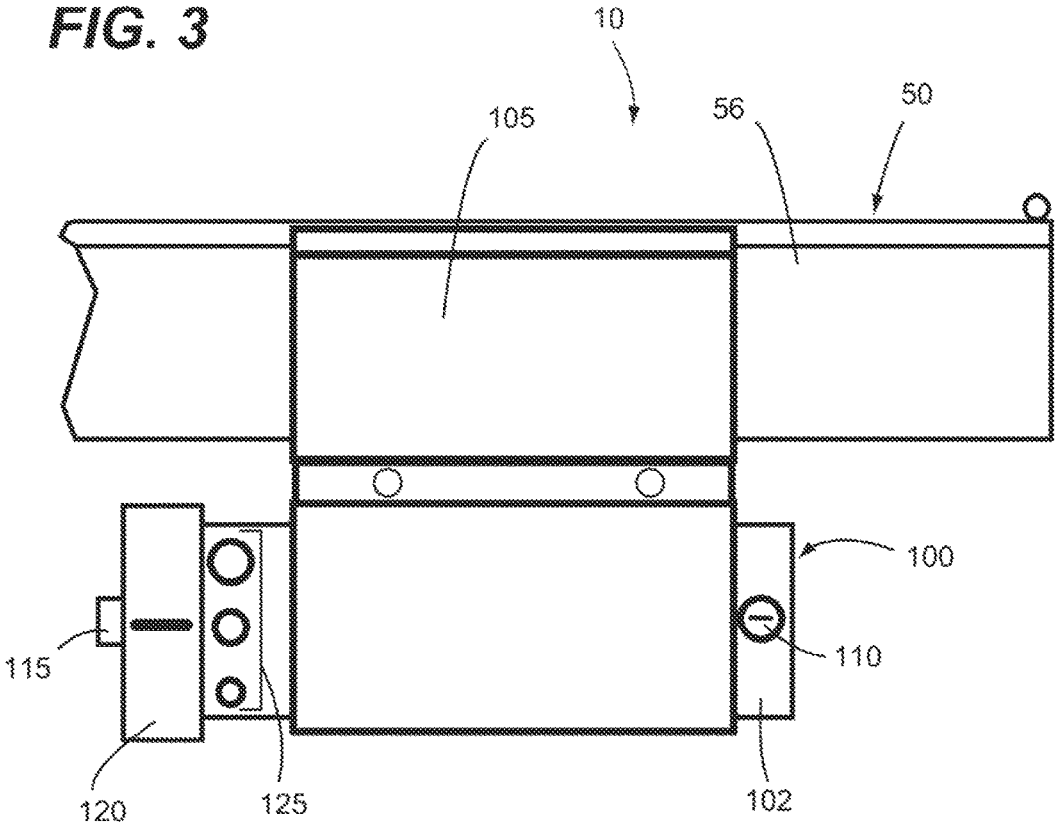
FIG. 3 is a partial side view of a sighting apparatus portion of the weapon system shown in FIG. 1.
Figure 4A:
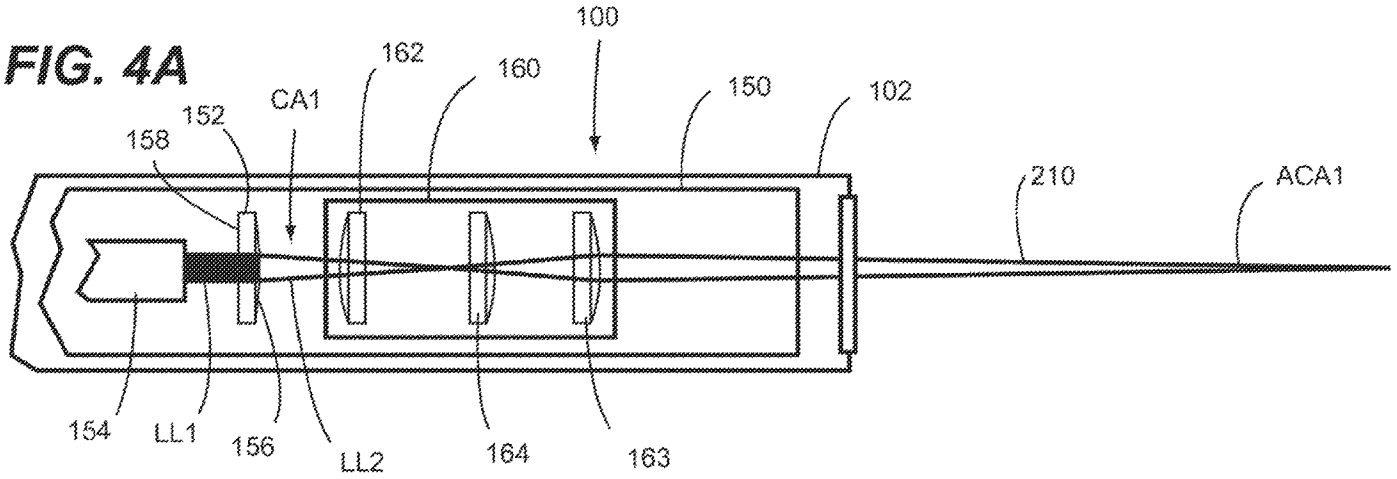
FIG. 4A is a diagrammatic view of an axicon-based implementation of a laser light emitting unit with a bean expander portion in a first cone angle adjustment setting.
Figure 4B:
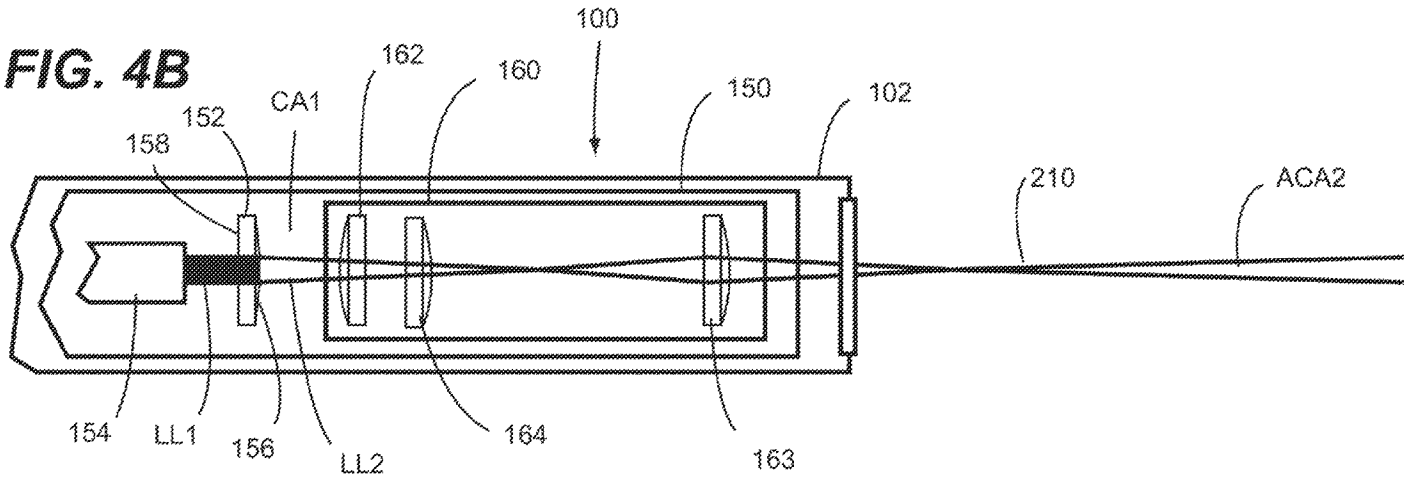
FIG. 4B is a diagrammatic view of the axicon-based implementation of the laser light emitting unit of FIG. 4A with the bean expander portion in a second cone angle adjustment setting.

Turning now to FIGS. 4A and 4B, an implementation of a laser light emitting unit of the sighting apparatus 100 discussed above in reference to FIGS. 1-3 is shown. The implementation of the laser light emitting unit shown in FIGS. 4A and 4B uses an axicon lens 152 (e.g., Edmunds Optics part no. 83-786) for producing the ring-shaped sighting reference 200. Accordingly, this depicted implementation of the laser light emitting unit is referred to herein as the axicon-based laser light emitting unit 150. The term axicon lens used herein refers to a lens with one planar face and one conical face.

A laser light generator 154, such as a 15 mW 532 nanometer laser, outputs a column-shaped (e.g., well-collimated) beam of laser light LL1. The axicon lens 152, which serves as a light ring generator, receives the column-shaped beam of laser light LL1 and producing a ring-shaped beam of laser light LL2 from the column-shaped beam of laser light LL1. The ring-shaped beam of laser light LL2 has a first cone angle CA1 as defined by parameters such as the profile of the conical face 156 of the axicon lens 152. Cone angle refers to a converging or diverging taper of a beam of light as a result of it passing through a lens. A planar face 158 of the axicon lens 152 faces the laser light generator 154. In some embodiments of the present invention, it may be desirable and/or beneficial for the axicon lens 152 to have a truncated conical face such that a dot-shaped beam of laser light at a central region of a round area surrounded by the ring-shaped beam of laser light LL2 is produced from the column-shaped beam of laser light LL1 (e.g., the a central dot of higher intensity than the surrounding ring of light).

A beam expander 160, which serves as a cone angle adjuster, receives the ring-shaped beam of laser light LL2. The ring shape of the ring-shaped beam of laser light LL2 is maintained through the beam expander such that the beam of light 210 that exits the housing 102 of the sighting apparatus 100 is ring-shaped. The beam expander 160 is movable to a plurality of cone angle adjustment settings. A first cone angle adjustment setting of the beam expander 160 is shown in FIG. 4A and a second cone angle adjustment setting of the beam expander 160 is shown in FIG. 4B. As shown in FIG. 4A, the beam expander 160 can comprise a first plano-convex lens 162 (e.g., Edmunds Optics part no. 49-915), a second plano-convex lens 163 (e.g., Edmunds Optics part no. 49-915) and a third plano-convex lens 164 (e.g., Edmunds Optics part no. 49-913), where the third plano-convex lens 164 is positioned between the first and second plano-convex lenses 162, 163 (e.g., with the planar face of each one of the first and second plano-convex lenses 162, 163 facing the third plano-convex lens 164). As shown in FIGS. 4A and 4B, the first plano-convex lens 162 can maintain a fixed position with respect to the axicon lens 152 whereas the second and third plano-convex lenses 162, 163 are moveable for providing desired cone angle adjustment.

The beam expander 160 being moved to a particular one of the cone angle adjustment settings causes the ring-shaped beam of laser light LL2 to be transitioned from having the first cone angle CA1 to a respective adjusted cone angle different than the first cone angle CA1 (e.g., a first adjusted cone angle ACA1 in FIG. 4A (e.g., +/−0.5 degrees at a focal point of the beam of light 210) and a second adjusted cone angle ACA2 in FIG. 4B (e.g., +/−2.0 degrees at a focal point of the beam of light 210)). For example, manual and/or electrical means of the beam expander (e.g., a lens translating structure) that is coupled to the light beam size selector can be implemented for enabling settings of the beam expander (e.g., lens positions) to be adjusted. The respective adjusted cone angle for each one of the cone angle adjustment settings is different than the respective adjusted cone angle for each other one of the cone angle adjustment settings. In this regard, the beam expander provides for the beam of light 210 that exits the housing 102 of the sighting apparatus 100 to be adjusted between a plurality of different cone angles (i.e., beam of light cross sectional sizes) and thus resulting ring-shaped sighting reference at a given distance are of correspondingly different sizes.

Figure 5:
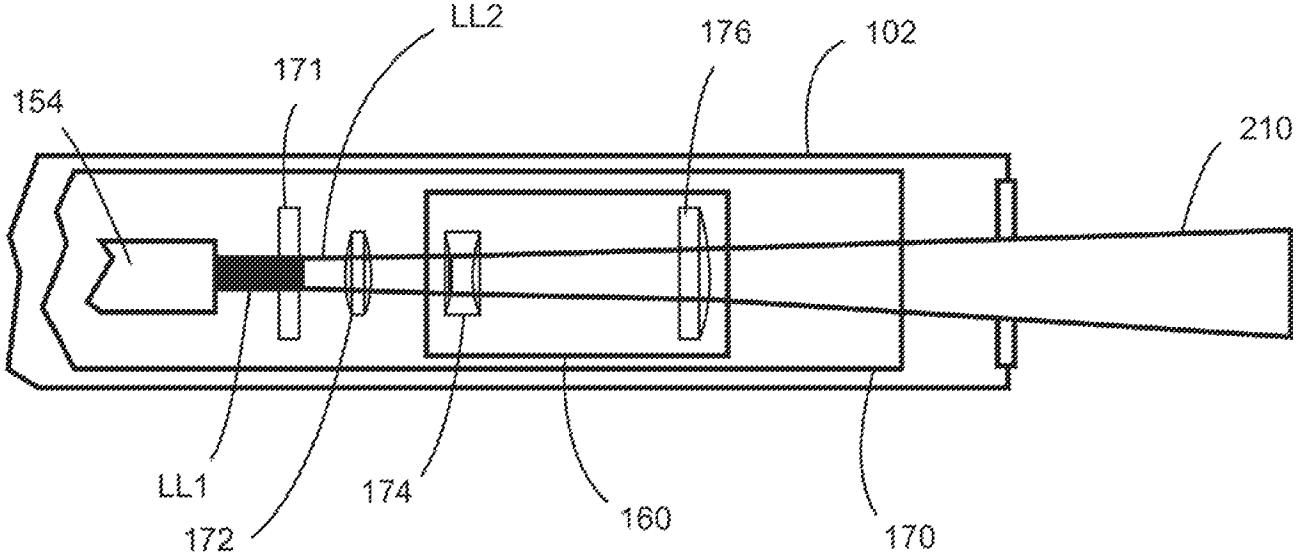
FIG. 5 is a diagrammatic view of a diffractor-based implementation of a laser light emitting unit.

Embodiments of the present invention are not limited to any particular implementation of a laser light emitting unit, aside from it providing for a beam of light having a ring portion at its perimeter (e.g., a ring of light that is lighter than light at a central region within the ring or a beam of light that is entirely or substantially ring-shaped). For example, as shown in FIG. 5, a diffractor-based laser light emitting unit 170 can be implemented in place of the axicon-based laser light emitting unit 150. In such an implementation, a diffractive element 171 (e.g., Frankfurt Laser Company part no. D075) is used in place of the axicon lens 152 and beam expander 160 can be configured with a double convex lens 172 (e.g., Edmunds Optics part no. 63-674), a double concave lens 174 (e.g., Edmunds Optics part no. 48-943), and a plano-convex lens 176 (e.g., Edmunds Optics part no. 69-410).

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A sighting apparatus adapted to be installed on a firearm capable of discharging shot pellet ammunition and slug ammunition, the sighting apparatus comprising:

a mounting bracket attachable to a firearm; and a light emitting unit coupled to the mounting structure, the light emitting unit comprising:

means for outputting a cone-shaped beam of light that is cone-shaped along a longitudinal axis thereof, defines a cone angle, and projects an illuminated sighting reference on a target a distance from the sighting apparatus;

means for outputting a second beam of light at a central region of the cone-shaped beam, wherein the second beam has a dot-shaped cross-section and is surrounded by the cone-shaped beam; and a light generator outputting a column-shaped beam of light that is received by the outputting means of the cone-shaped beam of light to produce the cone-shaped beam of light and is also received by the outputting means of the second beam of light to produce the second beam of light so that the cone-shaped beam of light and the second beam of light are both projected onto the target and the second beam of light is at the central region of the cone-shaped beam of light.

2. The sighting apparatus of 1, wherein the dot-shaped beam has a higher intensity than the cone-shaped beam.

3. The sighting apparatus of 1, wherein the cone-shaped beam has an annular-shaped cross-section so that the illuminated sighting reference projected by the cone-shaped beam on the target is annular shaped.

4. The sighting apparatus of 1, wherein the means for outputting the cone-shaped beam comprises:

a light ring generator that receives the column-shaped beam from the light generator and produces therefrom the cone-shaped beam.

5. The sighting apparatus of 4, wherein the light ring generator includes an axicon lens into which the column-shaped beam outputted from the light generator is directed.

6. The sighting apparatus of 5, wherein the means for outputting the second beam is a truncated conical face of the axicon lens that projects the second beam at the central region of the cone-shaped beam.

7. A sighting apparatus adapted to be installed on a firearm capable of discharging shot pellet ammunition and slug ammunition, the sighting apparatus comprising:

a mounting bracket attachable to a firearm; and a light emitting unit coupled to the mounting structure, the light emitting unit comprising:

means for outputting a cone-shaped beam of light that is cone-shaped along a longitudinal axis thereof, defines a cone angle, and projects an illuminated sighting reference on a target a distance from the sighting apparatus;

means for outputting a second beam of light at a central region of the cone-shaped beam, wherein the second beam has a dot-shaped cross-section and is surrounded by the cone-shaped beam;

a cone angle adjuster operable to adjust the cone angle of the cone-shaped beam, wherein the cone-shaped beam passes through the cone angle adjuster, the cone angle adjuster is movable to a plurality of cone angle adjustment settings, the cone angle of the cone-shaped beam at a first of the cone angle adjustment settings is different than the cone angle of the cone-shaped beam at a second of the cone angle adjustment settings, whereby at a fixed reference distance from the sighting apparatus a diameter of the illuminated sighting reference projected by the cone-shaped beam on the target at the first cone angle adjustment settings is different than the diameter of the illuminated sighting reference projected by the cone-shaped beam on the target at the second cone angle adjustment setting; and means for correlating the cone angle adjustment settings to different shot pellet ammunition capable of being discharged from the firearm.

8. The sighting apparatus of 7, wherein the light emitting unit further comprises a housing and the correlating means comprises indicia on the housing that correlates each of the cone angle adjustment settings to a corresponding one of the cone angles of the cone-shaped beam.

9. The sighting apparatus of 7, wherein:

the correlating means comprises a light beam size selector coupled to the cone angle adjuster;

the light beam size selector enables selection of a plurality of different light beam size settings that each correspond to a respective one of the cone angles; and selection of a particular one of the light beam size settings causes the cone angle adjuster to move to a corresponding one of the cone angle adjustment settings.

10. The sighting apparatus of 7, wherein the means for outputting the cone-shaped beam comprises:

a light generator outputting a column-shaped beam of light; and a light ring generator that receives the column-shaped beam from the light generator and produces therefrom the cone-shaped beam.

11. The sighting apparatus of 10, wherein the cone angle adjuster includes a beam expander into which the cone-shaped beam outputted from the light ring generator is directed.

12. The sighting apparatus of 10, wherein the light ring generator includes an axicon lens into which the column-shaped beam outputted from the light generator is directed.

13. The sighting apparatus of 12, wherein the means for outputting the second beam is a truncated conical face of the axicon lens that projects the second beam at the central region of the cone-shaped beam.

14. The sighting apparatus of 1, wherein the light emitting unit is a laser light emitting unit and the cone-shaped and second beams are laser beams.

15. The sighting apparatus of 1, wherein the sighting apparatus is installed on the firearm.

16. The sighting apparatus of 1, the sighting apparatus further comprising:

a cone angle adjuster operable to adjust the cone angle of the cone-shaped beam, wherein the cone-shaped beam passes through the cone angle adjuster, the cone angle adjuster is movable to a plurality of cone angle adjustment settings, the cone angle of the cone-shaped beam at a first of the cone angle adjustment settings is different than the cone angle of the cone-shaped beam at a second of the cone angle adjustment settings, whereby at a fixed reference distance from the sighting apparatus a diameter of the illuminated sighting reference projected by the cone-shaped beam on the target at the first cone angle adjustment settings is different than the diameter of the illuminated sighting reference projected by the cone-shaped beam on the target at the second cone angle adjustment setting; and means for correlating the cone angle adjustment settings to different shot pellet ammunition capable of being discharged from the firearm.

17. The sighting apparatus of 7, wherein the light emitting unit is a laser light emitting unit and the cone-shaped and second beams are laser beams.

18. The sighting apparatus of 7, wherein the sighting apparatus is installed on the firearm.

* * * * *